US005279759A

United States Patent [19]

Rebrovic et al.

[11] Patent Number: 5,279,759

[45] Date of Patent: Jan. 18, 1994

[54] ALPHA-(P-ALKOXYBENZYLIDENE) CARBOXYLIC ACIDS AS COLOR STABILIZERS, PROCESS, AIDS, AND WHITENERS FOR SOAPS

[75] Inventors: Louis Rebrovic, Cincinnati; Alan C. Kilbarger, Milford, both of Ohio

[73] Assignee: Henkel Corporation, Plymouth Meeting, Pa.

[21] Appl. No.: 987,884

[22] Filed: Dec. 9, 1992

[51] Int. Cl.[5] ..... C11D 9/26

[52] U.S. Cl. ..... 252/132; 252/108; 252/367; 252/399; 252/400.62; 252/407; 554/218; 562/465

[58] Field of Search ..... 252/108, 132, 367, 252/399, 400.62, 407; 562/465; 554/218

[56] References Cited

U.S. PATENT DOCUMENTS

| | | | |
|---|---|---|---|
| 4,526,701 | 7/1985 | Rubin | 252/113 |
| 4,683,001 | 7/1987 | Floyd et al. | 106/3 |
| 4,822,854 | 4/1989 | Ciolino | 252/174.19 |
| 4,833,259 | 5/1989 | Erlemann et al. | 424/60 |
| 4,942,174 | 7/1990 | Moeller et al. | 562/465 |
| 4,943,430 | 7/1990 | Hefford et al. | 8/405 |
| 5,039,513 | 8/1991 | Chatterjee et al. | 252/106 |
| 5,141,964 | 8/1992 | Noel | 252/106 |

OTHER PUBLICATIONS

George R. Whalley, Soaps, Cosmetics, Chemical Specialties, May, 1990, pp. 28–33.

L. Spitz (ed), *Soap Technology For The 1990's*, (American Oil Chemists' Society-Monograph, Champaign, Illinois), 1990, pp. 224, 87, 88, 220.

Edgar Woollatt, *The Manufacture Of Soaps, Other Detergents And Glycerine*, Halstead Press, Division of John Wiley & Sons, New York, 1985, pp. 152, 153, 140, 141.

Perkin and Schies, *J. Chem. Soc.*, 85:159–165 (1904).

Perkin, *J. Chem. Soc.*, 59, 150–164 (1891).

*Primary Examiner*—Paul Lieberman

*Assistant Examiner*—Bradley A. Swope

*Attorney, Agent, or Firm*—Ernest G. Szoke; Wayne C. Jaeschke; Frank S. Chow

[57] ABSTRACT

Alpha-(p-alkoxybenzylidene) carboxylic acids are used as color stabilizers, processing aids and whiteners for soap.

10 Claims, No Drawings

ALPHA-(P-ALKOXYBENZYLIDENE) CARBOXYLIC ACIDS AS COLOR STABILIZERS, PROCESS, AIDS, AND WHITENERS FOR SOAPS

BACKGROUND OF THE INVENTION

1. Field of the Invention

The present invention relates to the use of alpha-(p-alkoxybenzylidene) carboxylic acids of the formula:

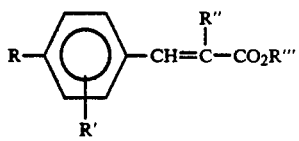

(I)

wherein R is alkoxy of 1 to 20 carbon atoms, R′ is hydrogen or alkoxy of 1 to 20 carbon atoms, or R and R′ taken together form 3,4-methylene dioxy, R″ is hydrogen or alkyl of 1–20 carbon atoms, and R‴ is hydrogen or an alkali metal, e.g., sodium or potassium, as color stabilizers, process aids and whiteners for soaps. The invention includes, within its scope, the resulting soap containing at least one compound according to formula I, hereinafter alternatively denoted Compound I.

2. Description of the Related Art

Human skin is generally cleansed with detergents, water, solvents or abrasives, singly or in combination. Among the detergents, soaps have probably enjoyed the widest use. Generally, toilet and household soaps are made by the vacuum chilling/extrusion process of a blend of about 15–25% lauric oil (coconut or palm kernel) and 75–85% hard fat, usually tallow or palm oil. See, for example, Edgar Woollatt "The Manufacture Of Soaps, Other Detergents And Glyceerine," Halsted Press, a division of John Wiley and Sons, New York, N.Y. 1985, 152 et seq.

The most common soap is manufactured by the saponification of a mixture of beef tallow and coconut oil at a ratio of about 80 parts tallow to 20 parts coconut oil. See, for example, chapter 9 of "Soap Technology For The 1990's", Luis Spitz, Ed., American Oil Chemist's Society—Monographer, Champaign, Illinois, 1990. The finished soap is packaged and marketed in a variety of shapes or forms. In order to keep the original overall appearance, odor, quality and performance characteristics, a variety of compounds have been used as preservatives. Most of these preservatives fall under the category of metal sequestrants and antioxidants. According to Whalley, in "Soaps/Cosmetics/Chemical Specialties," 1990:28, these include, for example:

EDTA (Ethylenediamine tetraacetic acid), sodium salt;
HEDP (1-Hydroxyethane-1, 1-diphosphonic acid), sodium salt;
DTPA (Diethylenetriamine pentaacetic acid), sodium salt;
HOEDTA (Hydroxyethenediamine triacetic acid), sodium salt;
NTA (Nitrillo triacetic acid), sodium salt;
Citric Acid (and sodium salt);
Phosphoric Acid (and sodium salt);
Stannous Chloride;
O-Tolyl Biguanide;
Magnesium Silicate; and
BHT (Butylated Hydroxytoluene).

ACS abstract RES. Discl. 213, 471–472 (1982) discloses the use of cinnamic acid in conjunction with glucose to help prevent discolorations of phenolic compounds in certain antibacterial soaps.

SUMMARY OF THE INVENTION

We have now found that when an effective amount of a compound of the formula (I):

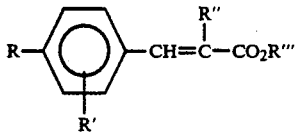

(I)

wherein R is alkoxy of 1 to 20 carbon atoms, R′ is hydrogen or alkoxy of 1 to 20 carbon atoms, or R and R′ taken together form 3,4-methylene dioxy, R″ is hydrogen or alkyl of 1–20 carbon atoms, and R‴ is hydrogen or an alkali metal, is added to soap formulations, it stabilizes the color, aids the processing of the soap formulation and increases the whiteness thereof. The preferred compound which falls within the scope of formula I is α-(p-methoxybenzylidene) stearic acid.

DETAILED DESCRIPTION OF THE INVENTION

According to the present invention, we have found that adding an effective amount of a compound of formula (I):

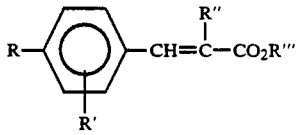

(I)

wherein R is alkoxy of 1 to 20 carbon atoms, R′ is hydrogen or alkoxy of 1 to 20 carbon atoms, or R and R′ taken together form 3,4-methylene dioxy, R″ is hydrogen or alkyl of 1–20 carbon atoms, and R‴ is hydrogen or an alkali metal, to soap formulations increases the whiteness or stabilizes the color of the resulting soap. In the above definitions for R and R′, alkoxy is preferably methoxy, and alkali metal is sodium or potassium. The preferred range of Compound (I) to be added to the soap is from about 0.01% to about 1% by weight for a typical soap formulation, and as stated above the preferred Compound I is α-(p-methoxybenzylidene) stearic acid.

Compound (I) is readily prepared by known procedures. Thus, α-(p-methoxybenzylidene) stearic acid is prepared from stearic anhydride, sodium stearate and p-methoxybenzaldehyde. 3,4-Dimethoxycinnamic acid is prepared according to Perkins and Schiess, J. Chem. Soc. 85 164 (1904) Whereas 3.4-methylenedioxy cinnamic acid is prepared according to Perkins, J. Chem. Soc. 59 12 (1891).

In a typical practice according to the present invention, the selected Compound (I) is added to the soap formulation by blending the ingredients e.g. tallow, coconut oil, before saponification with an aqueous alkali solution. The resulting soap is then processed by conventional procedures.

The whiteness of the soap prepared according to the present invention is compared with a soap containing 2-benzylidene stearic acid of the formula (II):

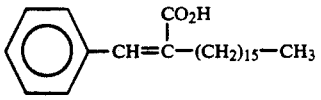

(II)

As will become more apparent from the experiments described below, the use of Compound (I) in the soap showed better color stability than Compound (II) in the same soap formulation.

In a commercial embodiment, the finished soap may include other additives such as fragrances, coloring matters and the like. In order to further illustrate the practice of this invention, the following Examples are included.

EXAMPLE 1

A mixture of 16.5 g (0.0300 mol) of stearic anhydride, 4.90 g (0.016 mol) of sodium stearate and 5.5 g (0.040 mol) of p-methoxybenzaldehyde were mixed and heated to 210° C. under dry conditions for 24 hours. Afterwards, the hot mixture was poured into 100 mL of $H_2O$ and boiled down to 50 mL of $H_2O$. This water addition/boil down process was repeated once more (to remove excess p-methoxybenzaldehyde). The resulting light tan solid was then heated under reflux in a solution of 4.1 g of KOH in 75 mL of $H_2O$ for 4 hours. The reaction mixture was cooled to room temperature and acidified with concentrated HCl, filtered and the resulting solid washed with $H_2O$. Stearic acid was distilled away from the solid using a 15×180 mm Vigreaux column (142°-176° C. head temperature at 0.15 mm Hg). The light brown waxy residue was triturated with iso-octane to give 2.36 g of white solid 2-(p-methoxybenzylidene) stearic acid. The iso-octane filtrate was allowed evaporate slowly in a crystallization dish to give an additional 5.30 g of solid product. Total yield: 7.66 g (62%) of 2-(p-methoxybenzylidene) stearic acid. The NMR spectra characteristics are as follows:

$^1$H NMR ($CDCl_3$) δ7.73 (S, 1H) δ7.11 (AA'BB'm 4H) δ3.83 (S,3H), δ2,54 (m, 2H), δ1.7-δ1.1 (m with large S at δ1.25, 28H), δ0.89 (t, 3H).

$^{13}$C NMR ($CDCl_3$) δ174.2, 159.8, 140.1, 131.2, 130.9, 128.1, 113.9, 55.2, 31.9, 29.9, 29.7, 29.4, 29.1, 27.4, 22.7, 14.1.

EXAMPLE 2

A mixture of 16.5 g (0.0300 mol) of stearic anhydride, 4.90 g (0.016 mol) of sodium stearate and 4.24 g (0.0400 mol) of freshly distilled benzaldehyde was heated to 230° C. under dry conditions for 72 hours. Afterwards, the hot reaction mass was poured into 100 mL of water and stirred vigorously. Approximately 20 mL of wash water was also added to the aqueous media. The mixture was boiled down to approximately 60 mL (to remove benzaldehyde) and then diluted to 170 mL with water. To this was added 2.0 g (0.036 mol) of KOH and the mixture was heated under reflux for another 1.5 hours. An additional 1.1 g of KOH was added and the mixture was heated under reflux for another 1.5 hours. The resultant tan mixture was acidified to approximately pH 2 with concentrated HCl to give a thick light brown waxy solid. The water phase was decanted off and 60 mL of methanol was added. The solid was pulverized in the e methanol and filtered off. Stearic acid was distilled away from the mixture using a 15×180 mm Vigreaux column (142°-176° C. head temperature at 0.15 mm Hg). The residue was then mixed with 50 mL of iso-octane and resulted in 1.39 g of solid 2-benzylidene stearic acid. The iso-octane mother liquor was treated with charcoal filtered and allowed to evaporate in a crystallization dish to give another 1.71 g of solid product. Total yield: 3.10 g (28%) of 2-benzylidene stearic acid. The NMR spectral characteristics of this compound are as follows:

$^1$H NMR ($CDCl_3/d_6$-DMSO) δ7.58 (S, 1H), δ7.36 (m, 5H), δ2.54 (m, 2H), δ1.6-δ1.15 (m with large S at δ1.25, 28H), δ0.869 (t, 3H).

$^{13}$C NMR ($CDCl_3/d_6$-DMSO) δ167.9u, 136.ld, 134.2u, 132.6u, 127.4d, 126.8d, 126.5d, 30.1u, 27.6u, 27.5u, 25.8u, 20.9u, and 12.6d.

EXAMPLE 3

A conventional 80/20 tallow/coconut oil soap was used to evaluate 2-(p-methoxybenzylidene) stearic acid, ("2-pMBSA?), and 2 benzylidene stearic acid, ("2-BSA"), as whiteness and color stabilizers. The soap had the following formulation:

| | |
|---|---|
| Tallow (80%) | 1200 g |
| Coconut Oil (20%) | 300 |
| NaOH | 237.6 |
| $H_2O$ | 594.3 |

This soap stock was prepared, dried, and processed under the usual conditions, The stearic acid derivatives were added to the fat fraction prior to neutralization and both were in concentration of 0.06%.

A COLORGARD SYSTEM/05 instrument (by Pacific Scientifc) was used to evaluate whiteness, etc. Reflectance values were based on the COLORGARD Lab-Hunter Scale, for whiteness. A higher "Lh" value indicates closer to white standard on the black-white axis; a more negative "ah" value indicates more green hue and a more positive "ah" e value, a more red hue; a more negative "bh" value indicates a more blue hue and a more positive "bh" value indicates a more yellow hue: WIE (313) is an ASTM whiteness index calculated from the "L" and "b" values.

| WHITE STANDARD | |
|---|---|
| Lh = | 92.45 |
| ah = | −1.27 |
| bh = | 2.08 |
| WIE= | 74.74 |

The following data are the results of the test.

| No Additive | | 2-BSA Added | | 2-pMBSA Added | |
|---|---|---|---|---|---|
| INITIAL VALUES | | | | | |
| Lh = | 82.00 | Lh = | 84.09 | Lh = | 87.76 |
| ah = | −3.38 | ah = | −2.99 | ah = | −3.33 |
| bh = | 5.56 | bh = | 5.98 | bh = | 6.16 |
| WIE = | 41.21 | WIE = | 41.97 | WIE = | 46.12 |
| VALUES AFTER 7 DAYS IN A 80° OVEN (UNWRAPPED) | | | | | |
| Lh = | 74.02 | Lh = | 71.30 | Lh = | 81.79 |
| ah = | −1.68 | ah = | −0.21 | ah = | −3.53 |
| bh = | 19.76 | bh = | 23.45 | bh = | 17.68 |
| WIE = | −28.78 | WIE = | −44.70 | WIE = | −15.75 |
| VALUES AFTER 14 DAYS IN A 80° OVEN (UNWRAPPED) | | | | | |
| Lh = | 73.37 | Lh = | 67.66 | Lh = | 81.82 |
| ah = | −2.01 | ah = | −1.54 | ah = | −2.10 |
| bh = | 20.57 | bh = | 22.60 | bh = | 17.97 |
| WIE = | −32.41 | WIE = | −41.60 | WIE = | −17.08 |

It is very obvious that the addition of 2-pMBSA to the soap stock produces a whiter soap bar initially. The NO e ADDITIVE and 2-BSA ADDED soap bars had initial WIE values of 41.21 (Lh=82.00) and 41.97 (Lh=84.09), whereas, the 2-pMBSA ADDED soap bar had an initially "whiter" value of 46.12 (Lh=87.76).

The 2-pMBSA ADDED soap bar also showed significantly better color stability than the NO ADDITIVE and 2-BSA ADDED soaps. This can be seen from the 7-day and 14-day oven test results.

What is claimed is:

1. A method for stabilizing the color of soap which comprises adding an effective stabilizing amount of a compound of the formula:

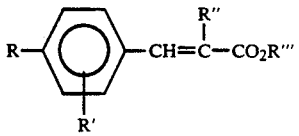

(I)

wherein R is alkoxy of 1 to 20 carbon atoms, R' is hydrogen or alkoxy of 1 to 20 carbon atoms, or R and R' taken together form 3,4-methylene dioxy, R'' is hydrogen or alkyl of 1-20 carbon atoms, and R''' is hydrogen or an alkali metal, into a soap formulation and thereafter processing the resulting blend to yield the soap.

2. A method according to claim 1 in which the amount of Compound I is between about 0.01% to 1%.

3. A method according to claim in which said compound is alpha-(p-methoxybenzylidene) stearic acid.

4. A method according to claim 2 in which said compound is alpha-(p-methoxybenzylidene) stearic acid.

5. A method according to claim 1 in which said soap formulation comprises about 75-85 parts by weight of tallow to about 15-25 parts by weight of coconut oil.

6. A soap which comprises an effective stabilizing amount of a compound of the formula (I):

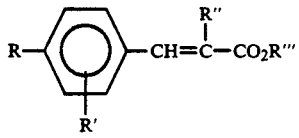

(I)

wherein R is alkoxy of 1 to 20 carbon atoms, R' is hydrogen or alkoxy of 1 to 20 carbon atoms, or R and R' taken together form 3,4-methylene dioxy, R'' is hydrogen or alkyl of 1-20 carbon atoms, and R''' is hydrogen or an alkali metal.

7. A soap according to claim 6 which is prepared from a blend of about 75 to 85 parts of tallow to 15 to 25 parts of coconut.

8. A soap according to claim 6 in which said compound is present from about 0.01% to about 1.0% by weight.

9. A soap according to claim 6 in which said compound is alpha-(p-methoxybenzylidene) stearic acid.

10. A soap according to claim 8 in which said compound is alpha-(p-methoxybenzylidene) stearic acid.

* * * * *